US010422188B2

(12) United States Patent
Zheng et al.

(10) Patent No.: US 10,422,188 B2
(45) Date of Patent: Sep. 24, 2019

(54) PIPE TRACKING SYSTEM FOR DRILLING RIGS

(71) Applicant: Schlumberger Technology Corporation, Houston, TX (US)

(72) Inventors: Shunfeng Zheng, Katy, TX (US); Benjamin Peter Jeffryes, Histon (GB); Christopher C. Bogath, Richmond, TX (US); Gokturk Tunc, Houston, TX (US); Jacques Orban, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 480 days.

(21) Appl. No.: 14/983,234

(22) Filed: Dec. 29, 2015

(65) Prior Publication Data

US 2016/0194950 A1 Jul. 7, 2016

Related U.S. Application Data

(60) Provisional application No. 62/100,772, filed on Jan. 7, 2015.

(51) Int. Cl.

| | |
|---|---|
| ***E21B 17/00*** | (2006.01) |
| ***E21B 19/24*** | (2006.01) |
| ***E21B 19/16*** | (2006.01) |
| ***E21B 19/20*** | (2006.01) |

(52) U.S. Cl.

CPC ..... *E21B 17/006* (2013.01); *E21B 17/00* (2013.01); *E21B 19/16* (2013.01); *E21B 19/20* (2013.01); *E21B 19/24* (2013.01)

(58) Field of Classification Search

CPC ..... E21B 17/006

See application file for complete search history.

(56) References Cited

U.S. PATENT DOCUMENTS

| | | | | |
|---|---|---|---|---|
| 4,202,490 | A | 5/1980 | Gunkel et al. | |
| 5,202,680 | A | 4/1993 | Savage | |
| 2011/0175343 | A1* | 7/2011 | Akins | G09F 3/00 283/74 |
| 2013/0063277 | A1 | 3/2013 | Christiansen | |
| 2014/0326507 | A1 | 11/2014 | Spriggs | |

FOREIGN PATENT DOCUMENTS

| | | | |
|---|---|---|---|
| WO | 2005001795 | A2 | 1/2005 |

* cited by examiner

*Primary Examiner* — Paul M. West

(74) *Attorney, Agent, or Firm* — Rachel E. Greene

(57) ABSTRACT

Pipes, drill strings including pipes, and methods for use on a drilling rig. The method includes obtaining pipe data for individual drill pipes of a drill string, obtaining a well trajectory for a well, obtaining one or more drilling measurements to be used when drilling the well, planning a first drill string based on the pipe data, the well trajectory, and the one or more drilling measurements, predicting an aging of the individual drill pipes in the first drill string while drilling the well using the first drill string, determining that a risk of failure of one or more individual pipes in the first drill string is unacceptable based on the aging of the individual pipes; and planning a second drill string in response to determining that the risk of failure is unacceptable in the first drill string.

3 Claims, 10 Drawing Sheets

PIPE TRACKING SYSTEM FOR DRILLING RIGS

CROSS-REFERENCE TO RELATED APPLICATIONS

This application claims priority to U.S. Provisional Patent Application having Ser. No. 62/100,772, which was filed on Jan. 7, 2015. The entirety of this priority application is incorporated herein by reference.

BACKGROUND

In drilling systems, such as those used in the oilfield industry, a drill pipe is deployed as part of a drill string into a wellbore, which allows a drill bit at a lower end of the drill string to advance in the wellbore. Fatigue life of the drill pipe may be tracked, as it may be advantageous to recognize when a drill pipe is nearing the end of its safe and useful life.

Generally, this life cycle is roughly tracked for the pipes in the aggregate as part of the drill string. The use of the drill pipe as part of the drill string may be recorded, and the drill pipe may be used one or several times, e.g., depending on hole depth, time spent drilling, drilling parameters (e.g., weight-on-bit, dog-leg severity, etc.).

To more precisely track fatigue life for individual pipes, tags have recently been proposed to be placed on or embedded within pipes. The general concept is that ruggedized radiofrequency identification (RFID) tags are placed on or embedded within the drill pipe. The tags are read as the drill pipe is deployed into the wellbore, and the tags stay with the drill pipe during its trip in and out of the wellbore. However, the pipe material, which is typically a ferrous metal, may interfere with the signal of the RFID tags, making them difficult to read. Further, the RFID tags frequently fail in the harsh conditions in the wellbore, which may result in frequent replacement or reversion to the rough approximation of fatigue life explained above.

SUMMARY

Embodiments of the disclosure may provide a pipe for a drill string. The pipe includes an identifier that represents an identification number that is read by a sensor. The identifier includes one or more physical features of the pipe.

Embodiments of the disclosure may also provide a drilling rig system. The drilling rig system includes a drill string including pipes, each including an identifier configured to represent an identification number. The identifier includes one or more physical features of the respective pipe. The system also includes a sensor configured to read the identification number from the identifier.

Embodiments of the disclosure may also provide a pipe for a drill string. The pipe includes a recess, a memory chip disposed in the recess, the memory chip storing an identification number associated with the pipe, and an electrode coupled to the memory chip and positioned at a radial outside of the recess. The electrode is configured to receive a signal representing the identification number and to convey the signal to a sensor.

Embodiments of the disclosure may further provide a method. The method includes obtaining pipe data for individual drill pipes of a drill string, obtaining a well trajectory for a well, obtaining one or more drilling measurements to be used when drilling the well, planning a first drill string based on the pipe data, the well trajectory, and the one or more drilling measurements, predicting an aging of the individual drill pipes in the first drill string while drilling the well using the first drill string, determining that a risk of failure of one or more individual pipes in the first drill string is unacceptable based on the aging of the individual pipes; and planning a second drill string in response to determining that the risk of failure is unacceptable in the first drill string.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
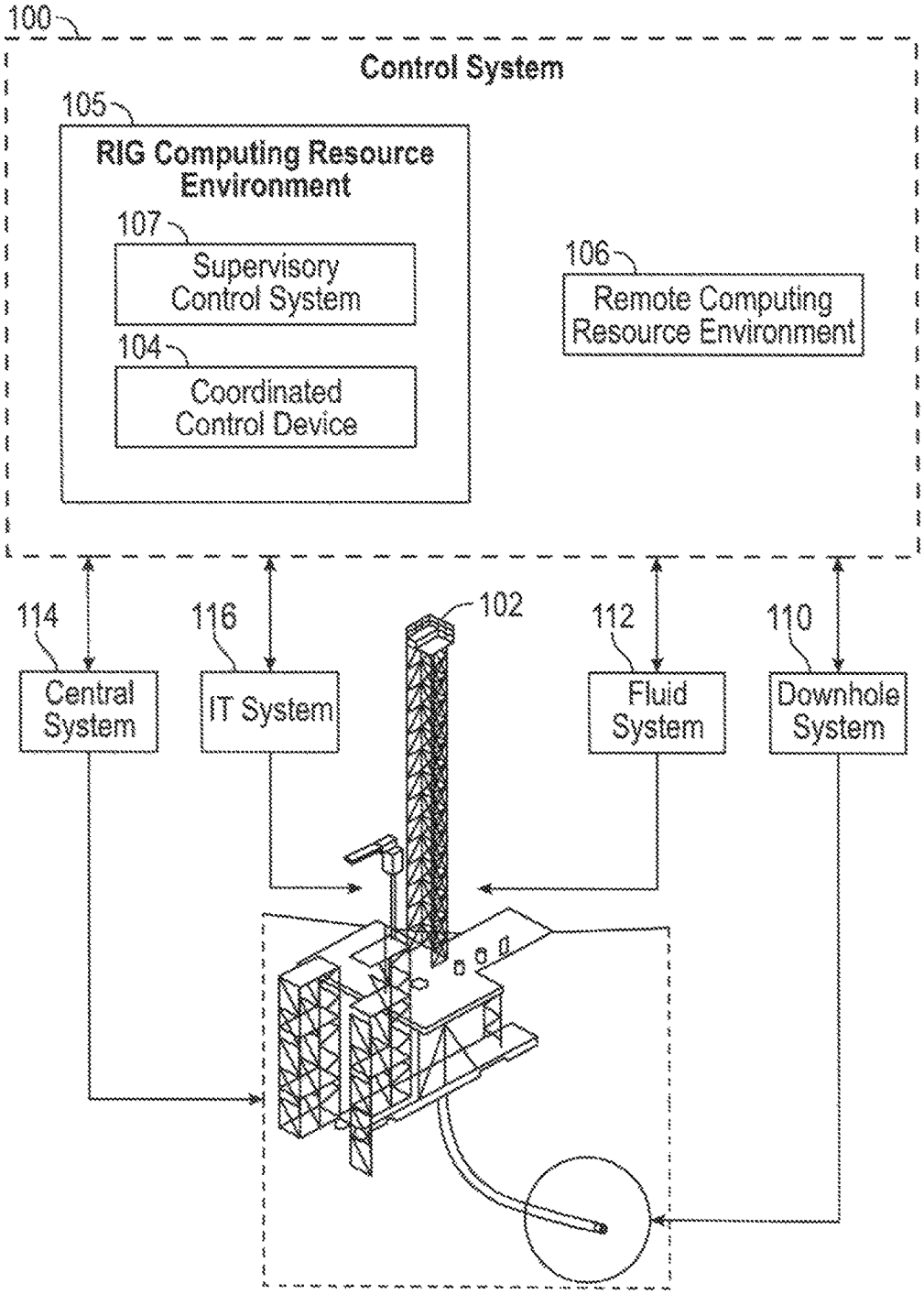
FIG. 1 illustrates a schematic view of a drilling rig and a control system, according to an embodiment.

In general, embodiments of the present disclosure may enable a more detailed analysis of the life cycle for individual pipes, which may facilitate planning of a drill string and while safely maximizing pipe fatigue life. In particular, fatigue life may be at least partially dependent upon the specific location of the drill pipe in the drill string, as not all time spent as part of a drill string in a wellbore is equivalent in terms of fatigue. For example, the tensile load on a drill pipe toward the distal end of the string may be relatively low in comparison to a drill pipe positioned proximal to the surface; however, compressive friction forces may be higher in horizontal sections of the drill string. Similarly, the torque loading of such pipes may vary along the drill string. Bending cycles experienced may also differ as between pipes along a single drill string, e.g., according to the number of rotations that the drill pipe spends in a curved portion of the wellbore.

Accordingly, embodiments of the present disclosure may provide a pipe with an identifier built into it, along with a system for tracking the pipes using the identifiers. The identifier may avoid the drawbacks associated with RFID chips in the drill pipe. For example, the identifier may include one or more physical features of the pipe, which may represent a pipe identification number that may be read by a sensor of a drilling rig. The physical features may be at least partially integral with the pipe (e.g., milled or cut into the pipe). Plugs or other structures may be paired with the physical features of the pipe to further represent a pipe identification number. Further, one or more microchips may be contained within the physical feature, and electrical contacts may communicate with the microchips, thereby allowing the microchips to communicate the identification number to the sensor, when the sensor is in contact with the electrical contacts. These and other features of the present disclosure are described in greater detail below.

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection).

Further, the drilling rig 102 may include various systems with different sensors and equipment for performing operations of the drilling rig 102 that may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. In some embodiments, the drilling rig 102 may include an information technology (IT) system 116. The downhole system 110 may include, for example, a bottomhole assembly (BHA), mud motors, sensors, etc. disposed along the drill string, and/or other drilling device configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, draw-works, pumps, generators, tubular handling equipment, derricks, masts, substructures, and other suitable equipment. Accordingly, the central system 114 may perform power generation, hoisting, and rotating operations of the drilling rig 102, and serve as a support platform for drilling device and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, etc.). An embodiment of the control system 100 that is unified, may, however, provide control over the drilling rig 102 and its related systems (e.g., the downhole system 110, fluid system 112, and/or central system 114).

Figure 2:
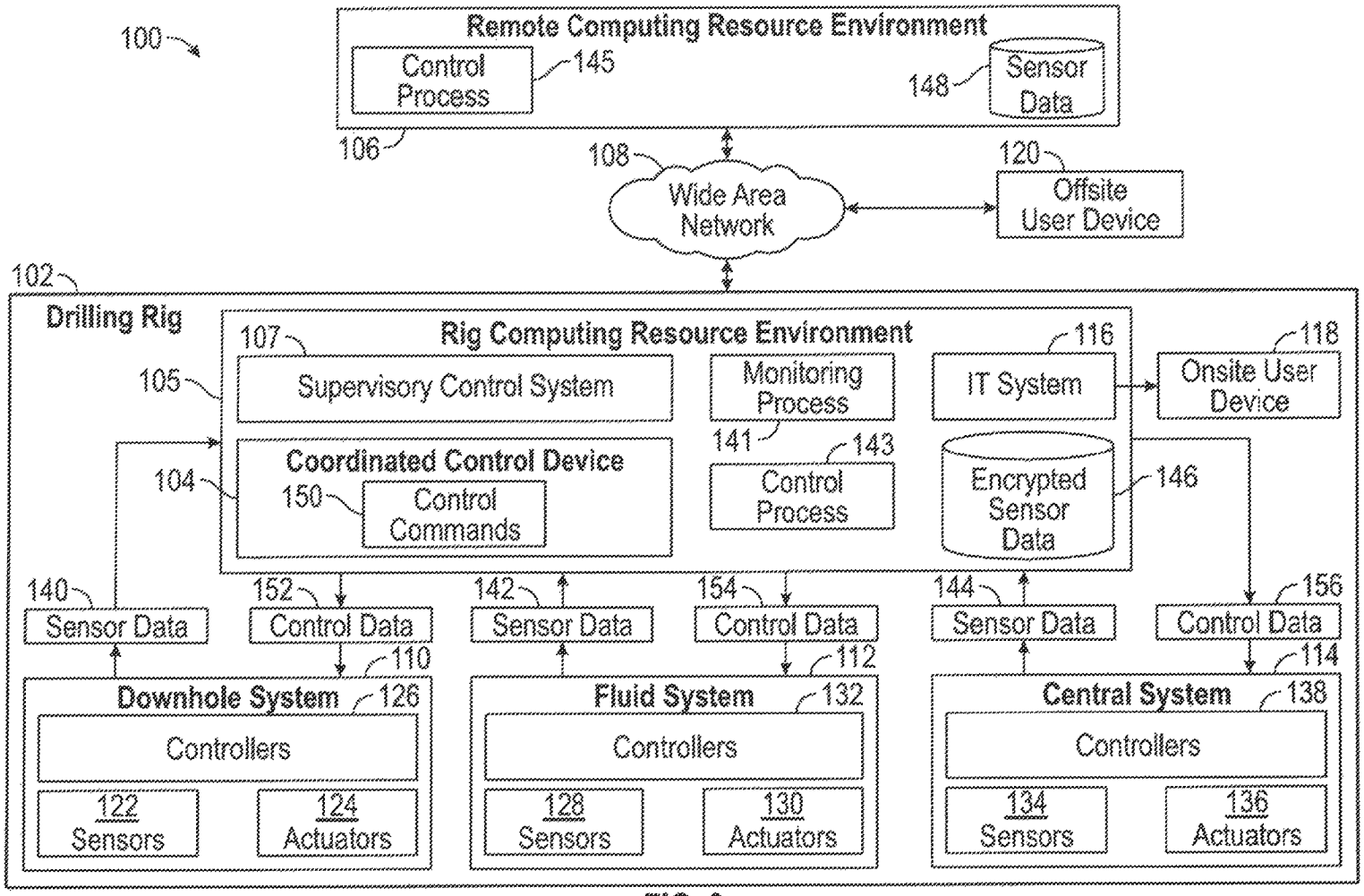
FIG. 2 illustrates a schematic view of a drilling rig and a remote computing resource environment, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The systems of the drilling rig 102 may include various sensors, actuators, and controllers (e.g., programmable logic controllers (PLCs)). For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data at the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. The variation in measurements at different locations over time may be used to determine equipment performance, system performance, scheduled maintenance due dates, and the like. For example, slip status (e.g., in or out) may be acquired from the sensors and provided to the rig computing resource environment 105. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g. tripping speed). When it is desired to maintain certain downhole pressure during tripping, the coordinated control device 104 may be used to direct the appropriate control commands.

In some embodiments, control of the various systems of the drilling rig 102 may be provided via a three-tier control system that includes a first tier of the controllers 126, 132, and 138, a second tier of the coordinated control device 104, and a third tier of the supervisory control system 107. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The encrypted sensor data 146 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a thin client configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 154 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. In some embodiments, the rig computing resource environment 105 may include control processes 143 that may use the sensor data 146 to optimize drilling operations, such as, for example, the control of drilling device to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. A user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

Figure 3:
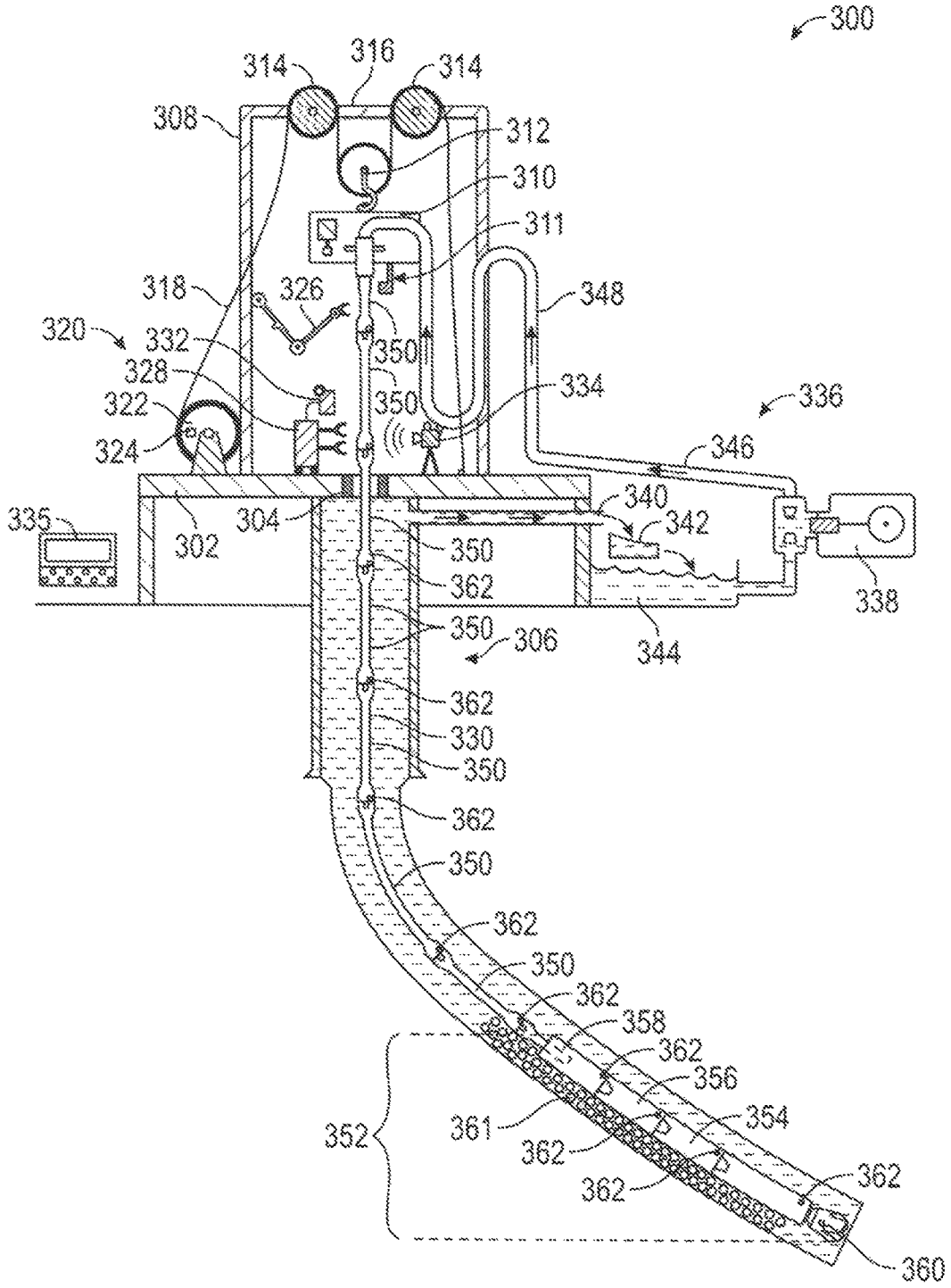
FIG. 3 illustrates a side, schematic view of a drilling system, according to an embodiment.

FIG. 3 illustrates a side, schematic view of a drilling system 300, according to an embodiment. The drilling system 300 generally includes a top-side assembly ("central package") and a downhole assembly, although additional assemblies, components, etc. may also be provided.

The top-side assembly generally includes a rig floor 302, which may include a rotary table 304 aligned with and positioned over a wellbore 306. A mast 308 may extend upwards from the rig floor 302. A drilling device 310, such as a top drive, kelly, etc. may be suspended from the mast 308. "Drilling device" refers to any device or devices capable of supporting and rotating the tubular as part of a drilling operation. The drilling device 310 may include a sensor 311, which may detect the presence of a pipe connected or "made up" to the drilling device 310, and may also be employed to acquire pipe identification information, as will be described in greater detail below.

For example, as shown, the drilling device 310 may be coupled to a travelling block 312, which may in turn be suspended from sheaves 314 of a crown block 316. The sheaves 314 may support a drill line 318, which may extend to a drawworks 320. The drawworks 320 may include a drum 322, which may be rotatable to spool or unspool the drill line 318, and thereby control the elevation of the drilling device 310. An encoder 324 may be included in the drawworks 320, as well, and may sense angular displacement of the drum 322, so as to track the length of the drill line 318, allowing for the elevation of the drilling device 310 to be inferred.

The top-side assembly may also include a pipe handler 326, which may serve to move a stand of pipe into position above the wellbore 306. In other embodiments, an elevator (e.g., a single-joint elevator) may be employed in lieu of such a pipe handler 326, which may be configured to bring new stands of one or more pipes into engagement with the drilling device 310. The top-side assembly may further include an iron roughneck 328, which may serve to make a connection between a new stand and the drilling device 310 and/or a previously-deployed drill string 330 that extends into the wellbore 306. The iron roughneck 328 may include a sensor 332, which may be configured to acquire identifying information from the pipes of the drill string 330, as will be described in greater detail below. The top-side assembly may also include a camera 334, or another type of optical sensor, which may be aimed at the drill string 330 above the rig floor 302.

A computing device 335 may be coupled with the roughneck 328, the camera 334, the encoder 324, the sensor 311, or any combination thereof, and may acquire data therefrom. The computing device 335 may include one or more processors, memory, input/output peripherals, etc., so as to support operation thereof. The computing device 335 may be implemented as part of the rig control system 100, as described above, or may be a stand-alone unit. Additional details regarding an embodiment of operation of the computing device 335 are provided below.

The top-side assembly may also include a mud system 336. The mud system 336 may include a pump 338, sometimes referred to as a "mud triplex" because it may be a three-plunger pump, although any type of pump may be employed consistent with the present disclosure. The mud system 336 may also include a mud return line 340, which may extend from the wellbore 306, e.g., from a blowout preventer positioned at the top of the wellbore 306. The mud system may also include a managed pressure drilling system, which may include one or more chokes, to control the pressure of the mud in the wellbore 306.

The mud system 336 may further include a shale shaker 342 for removal of relatively large cuttings from the mud. Additional particulate removal structures (cyclones, sedimentary separates, etc.) may also be provided for processing the mud returned from the wellbore 306. The process mud may then be deposited in a mud tank 344 or "pit", and may be fed to the pump 338 therefrom.

The mud may be delivered from the pump 338 to the drilling device 310 via a delivery line 346 and a standpipe 348. The mud may then proceed through the drilling device 310, into the drill string 330, and may eventually be circulated back to the return line 340.

The downhole assembly may include at least a portion of the drill string 330. A series of pipes 350 may be connected together, end-on-end to form at least a portion of the drill string 330. During the drilling process, the drilling device 310, pipe handler 326, and roughneck 328, among other devices, may add pipes 350 to the string 330, and then lower the string 330 farther into the wellbore 306.

The string 330 may also include a bottom-hole assembly (BHA) 352. Among other potential components, the BHA 352 may include a measurement-while-drilling (MWD) device (and/or a logging-while-drilling (LWD) device) 354, a drill collar 356, a jar 358, and a drill bit 360. Mud may be delivered through the string 330, the jar 358, the drill collar 356, and the device 354, ultimately to the drill bit 360. The mud may be ejected from the drill bit 360, into the wellbore 306, and circulated back toward the return line 340. During such circulation, the mud may entrain cuttings 361 within the flow, lifting the cuttings out of the wellbore 306 and back to the mud system 336.

One, some, or each of the pipes 350 and/or the components of the bottom-hole assembly 352 may include an identifier 362. The identifiers 362 may be read by the sensor 332 of the roughneck 328 and/or the sensor 311 of the drilling device 310. The sensor 332 and/or sensor 311 may interpret the identifier 362, e.g., to determine a serial number, or another identification, corresponding to the pipe 350. Information about the pipe 350 may be stored in a database, for example, in the computing device 335 (or to which the computing device 335 has remote access, etc.).

The camera 334 may operate to acquire one or more (e.g., about 30) images of each pipe 350 as it is lowered into the wellbore 306. Such images may be employed to inspect the pipes 350, and the images may be stored in a database, for example, in the computing device 335, in association with an identification number represented by the identifier 362.

Figure 4:
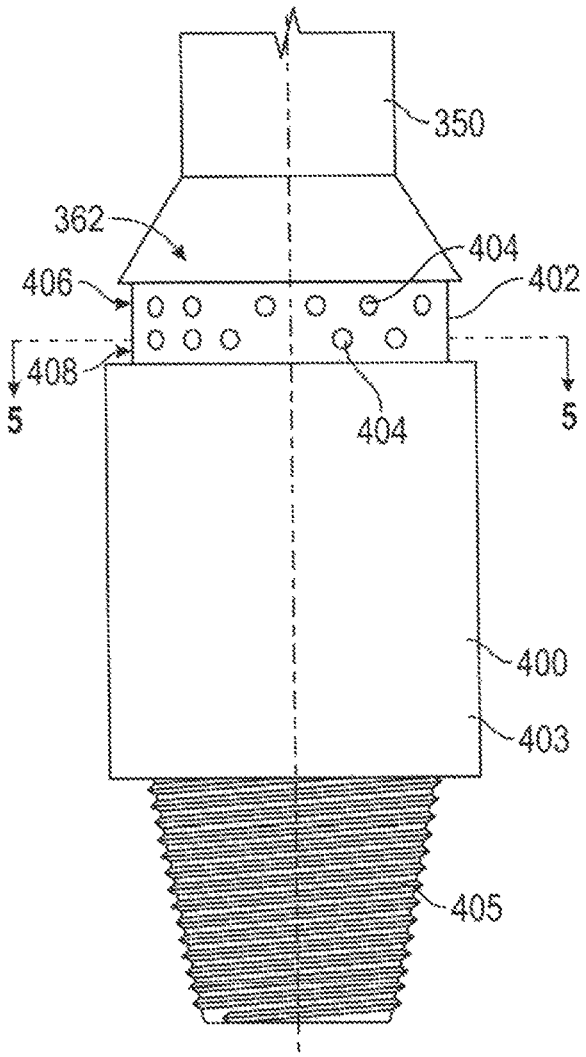
FIG. 4 illustrates a side, perspective view of a pipe having an identifier, according to an embodiment.
Figure 5:
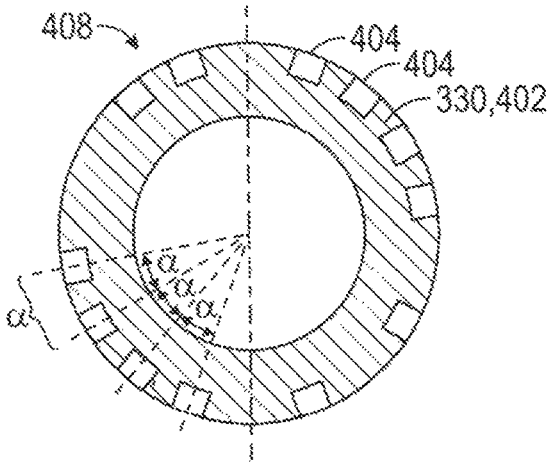
FIG. 5 illustrates a cross-sectional view of the pipe, showing another depiction of the identifier thereof, according to an embodiment.

FIG. 4 illustrates a side, perspective view of a pipe 350 having an identifier 362, according to an embodiment. FIG. 5 illustrates a cross-sectional view of the pipe 350, showing another depiction of the identifier 362 thereof, according to an embodiment. In particular, the pipe 350 may have a tong area 400 and a recess 402, which may be located on a pipe joint 403, e.g., proximal to a pin end 405 thereof. The identifier 362 may be positioned within the recess 402, e.g., for protection from wear. The tong area 400 may thus have a larger diameter than the recess 402 and may be configured to interact with tongs (e.g., of the roughneck 328 or another device), e.g., for manipulation of the pipe 350.

The identifier 362 may include one or more indicators 404, which may, in some embodiments, be or include a physical feature of (e.g., integral with) the pipe 350. In this embodiment, two rows 406, 408 of indicators 404 are provided, each row 406, 408 being positioned at an expected axial interval of the pipe 350. The indicators 404 are further disposed at circumferential (angular) intervals α around the circumference of the pipe 350 in the recess 402. The indicators 404, in this embodiment, may be blind holes which may have a depth that is less than the wall thickness of the pipe 350 at the recess 402, such that the pipe 350 may not leak fluid from within. In an embodiment, the holes may be about 6 mm (e.g., about ¼") in depth, and about 10 mm (e.g., about ⅜") in diameter.

Accordingly, the placement, spacing, and non-placement of the indicators 404 may provide information to a reader (e.g., on the roughneck 328 and/or the drilling device 310). For example, the indicators 404 may provide a start sequence, which may represent the angular starting position for the array. Next, at expected circumferential intervals, a hole may exist (e.g., providing a binary '1') or may not exist (binary '0'). As such, the indicators 404 may provide an identification number to the reader capable of detecting discontinuities such as the holes (indicators 404) in the surface of the pipe 350. The set of possible numbers for a given identifier 362, in this embodiment, increases with the number of indicators 404, which may be increased by reducing the circumferential spacing and/or by providing additional rows.

Figure 6:
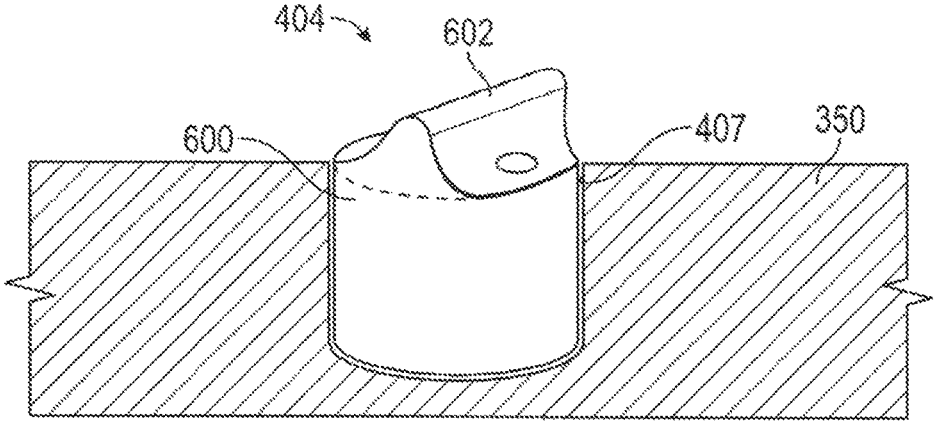
FIG. 6 illustrates a partial cross-sectional view of another embodiment of the identifier, according to an embodiment.

FIG. 6 illustrates a partial cross-sectional view of another embodiment of the indicator 404, according to an embodiment. The indicator 404 may include a hole 407, similar to the holes described above, and a plug 600 may be secured therein, e.g., via brazing, press-fitting, etc. In some cases, the plug 600 may simply serve to provide a different material to contrast with the surrounding material of the pipe 350. For example, the plug 600 may be formed at least partially from a polycrystalline diamond (PCD) material, which may be non-magnetic and/or non-conductive, in some embodiments, which may thus contrast with the ferrous material of the surrounding pipe 350.

Figure 7:
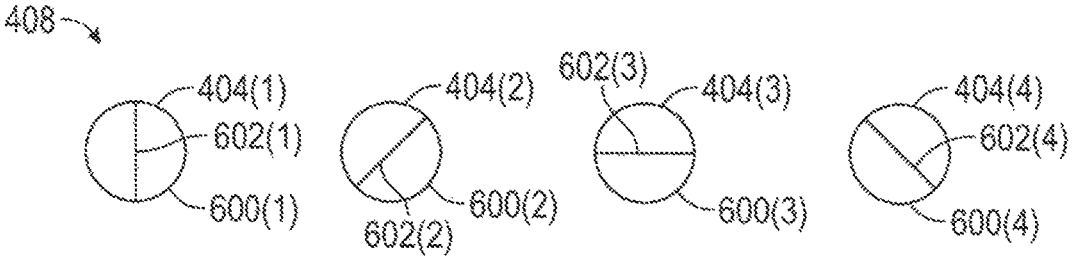
FIG. 7 illustrates a view of a row of holes of the identifier, according to an embodiment.

As shown, the plug 600 may provide an additional feature, which may multiply the amount of data that a single indicator 404 may provide to a reader. For example, an orientation of a geometry of the plug 600 may allow for such increased data representation for a single indicator 404 of the identifier 362. In particular, in the illustrated embodiment, the plug 600 may include a dome-shaped top 602, providing a ridge, peak, or another geometry. Further, as shown in FIG. 7, for a partial row 408 of indicators 404(1)-(4), the plugs 600(1)-(4) may be rotated relative to one another, thereby positioning the dome-shaped tops 602(1)-(4) in detectably different orientations, depending on the sensitivity of the reader and the installation process. For example, as shown, four different positions of the plug 600 may be detectable, thus yielding two bits of digital information for each indicator 404. It will be appreciated that any number of angular orientations may be distinguished, with the illustrated four merely being an example.

Figure 8:
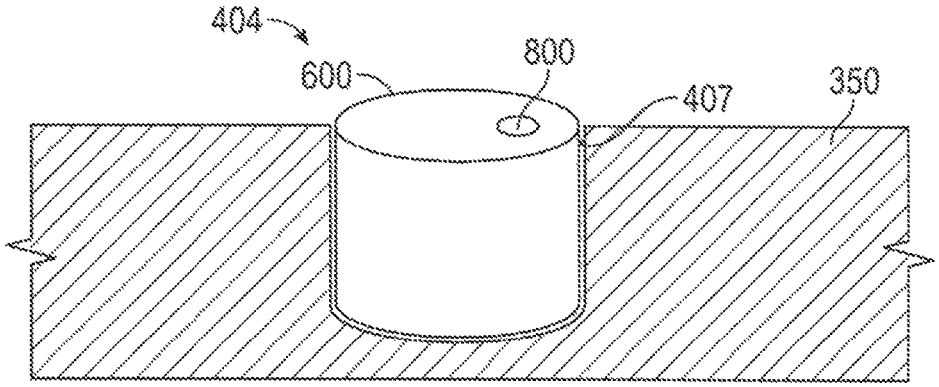
FIG. 8 illustrates a side, partial cross-sectional view of another embodiment of the identifier, according to an embodiment.

FIG. 8 illustrates a side, partial cross-sectional view of another embodiment of the indicator 404, e.g., again including the plug 600. The plug 600 of FIG. 8, however, may include a second plug 800 in the top 602 of the plug 600. The second plug 800 may be formed from a detectably different material than the rest of the top 602. For example, the second plug 800 may be formed from a non-conductive, non-magnetic PCD material (e.g., using a $CaCO_3$ catalyst) while the remainder of the plug 800 may be formed from a conductive, magnetic PCD material (e.g., using a Cobalt catalyst).

Figure 9:
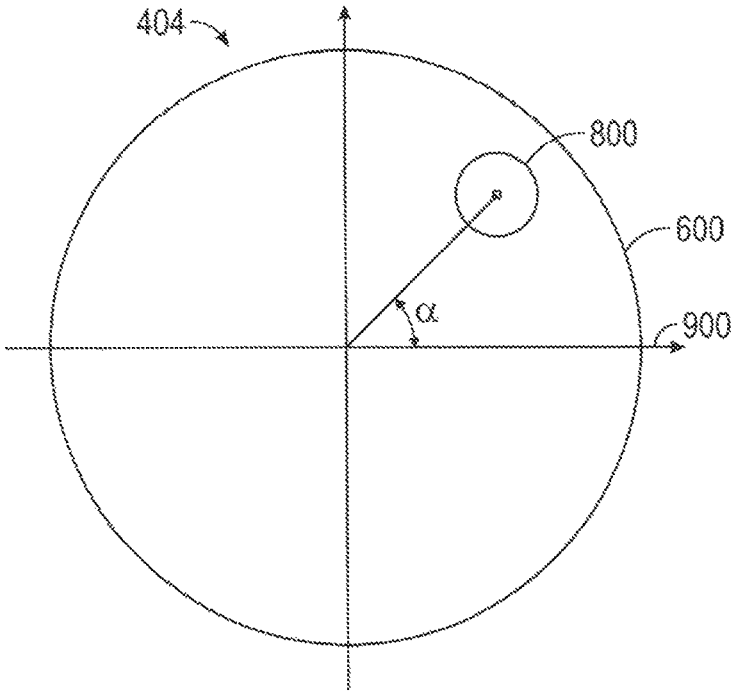
FIG. 9 illustrates a top view of the plug being rotated relative to a reference axis, according to an embodiment.

The second plug 800 may thus be positioned in multiple different ways to further differentiate the plugs 600 from one another, in order to convey a greater amount of information for each individual indicator 404. For example, as shown in FIG. 9, the plug 600 may be rotated, and an angle α may be tracked between an axis 900 (e.g., straight circumferential with respect to the pipe 350) and the second plug 800. Each different angular position may correspond to a different number. For example, eight positions may be detectable in this embodiment, yielding three bits of digital information per indicator 404. Again, it will be appreciated that any number of angular orientations may be distinguished depending on a variety of factors.

Figure 10A:
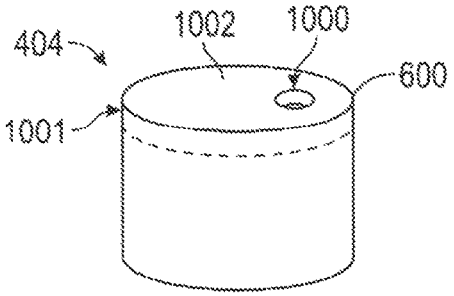
FIGS. 10A and 10B illustrate two further embodiments of the identifier.
Figure 10B:
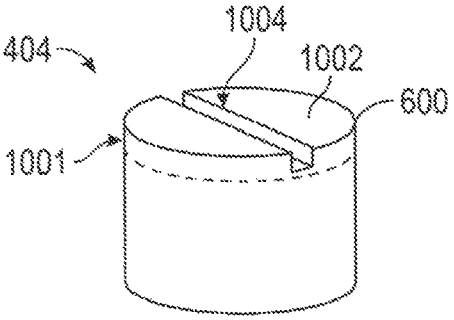

FIGS. 10A and 10B illustrate two further embodiments of the indicator 404, including the plug 600. In the embodiments of FIGS. 10A and 10B, a discontinuity may be formed in a top 1002 of the plug 600, which may be detected, such that the discontinuity represents at least a portion of the identification number. Specifically, in FIG. 10A, the discontinuity in the plug 600 may be a hole 1000, which may extend inward from the top 1002. An outer layer 1001 may be provided, which may be integral with a remainder of the plug 600, but may have another material, such as a PCD, leached therein. The PCD may increase (or decrease) an electrical and/or magnetic conductivity of the outer layer 1001 in comparison to a remainder of the plug 600, and thus the position of the hole 1000 may be detectable via surface conductivity measurements in the plug 600. Thus, the plug 600 of FIG. 10A may convey information similarly to the plug 600 of FIGS. 8 and 9, e.g., including the angular position of the hole 1000.

The plug 600 of FIG. 10B may provide the discontinuity in the form of a groove 1004 in the outer layer 1001, extending from the top 1002, and thus may similarly be detected via surface conductivity in the top 602. Thus, the plug 600 may convey information similarly to the plug 600 of FIGS. 6 and 7, e.g., including the orientation of the groove 1004.

Figure 11:
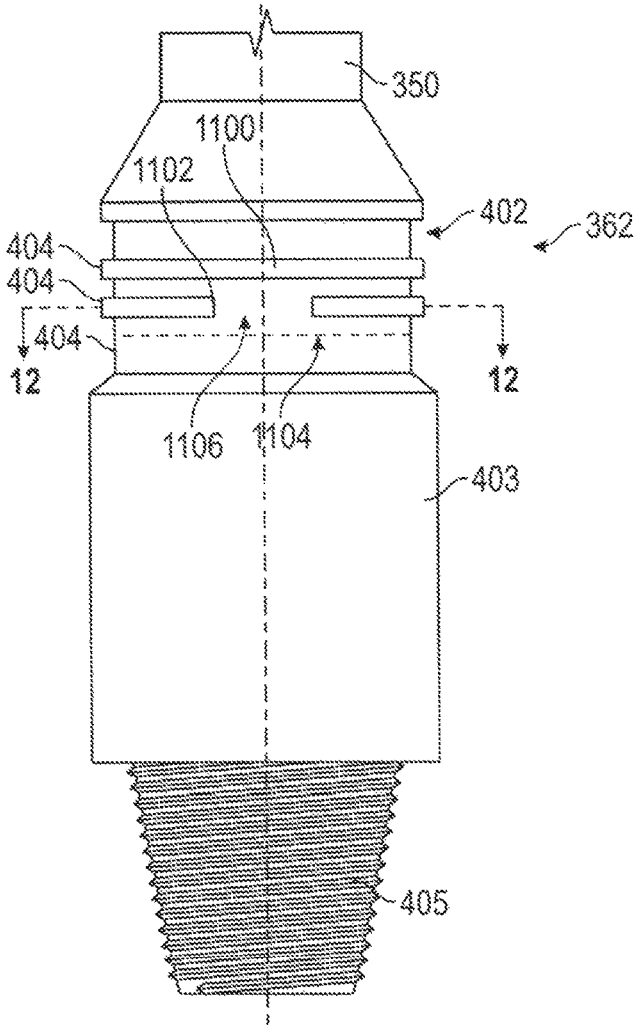
FIG. 11 illustrates a side, perspective view of the pipe with the identifier, according to another embodiment.

FIG. 11 illustrates a side, perspective view of the pipe 350 with the identifier 362, according to another embodiment. As with the previous embodiments, the identifier 362 may include one or more indicators 404. In this embodiment, the indicators 404 may be provided ridges (two are shown: 1100, 1102) which may extend radially outward from the outer surface of the recess 402. For example, the identifier 362 may convey information by the presence and absence of ridges 1100, 1102, e.g., at uniform axial intervals along the pipe 350. Thus, the ridge 1100 may be provided at the first position, which may indicate a bit value of 1. The ridge 1102 may be provided at the second position, which may also indicate a bit value of 1. The identifier 362 may include a third position, axially below the ridge 1102, but, as shown at position 1104, there may not be a ridge below the ridge 1102. Thus the third position may have a bit value of 0. If the identifier 362 provides three bits of information, the result may be a binary identifier '110'.

Figure 12:
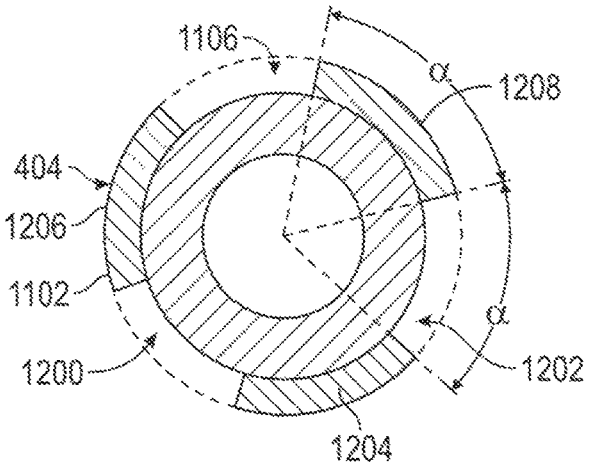
FIG. 12 illustrates a cross-sectional view of the pipe, according to an embodiment.

Further, the ridges 1100, 1102 may provide additional bits of information in the circumferential direction. For example, the ridge 1102 may include a gap 1106. Referring to FIG. 12, a cross-sectional view of the pipe 350 is shown, illustrating the ridge 1102 with the gap 1106. The view of FIG. 12 also shows a second gap 1200 and a third gap 1202, which together separate the ridge 1102 into three circumferentially-extending segments 1204, 1206, 1208. The indicators 404 may thus be provided based on whether, in a given circumferential (angular) interval $\alpha$, the ridge 1102 includes a segment or a gap. For example, if the angle $\alpha$ is 60 degrees, then a given ridge 1102 may provide six bits of information (and if the ridge is missing, as in position 1104, FIG. 11, six bits may still be provided, all corresponding to gaps). Thus, the ridges 1100, 1102 may provide six bits of information each, rather than one.

Figure 13:
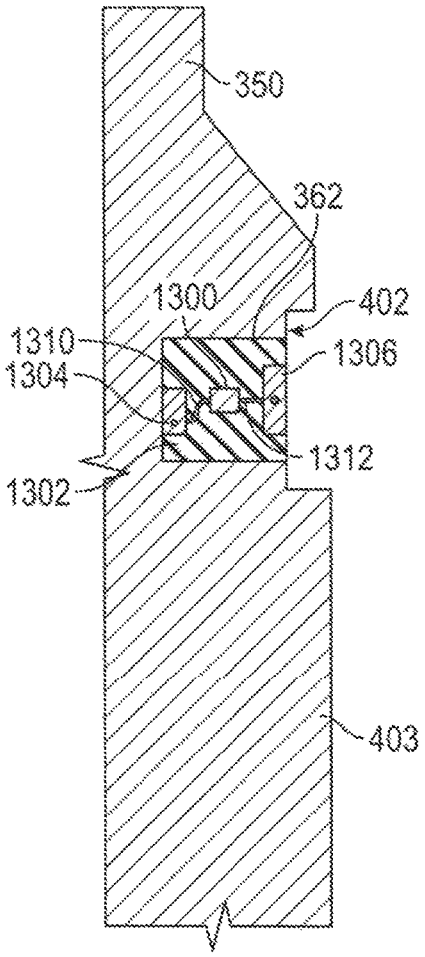
FIG. 13 illustrates a cross-sectional view of another pipe, including an identifier therein, according to an embodiment.

FIG. 13 illustrates another embodiment of the pipe 350 and the identifier 362. In this embodiment, the identifier 362 includes a memory device 1300. The memory device 1300 may be any device capable of storing and transmitting information. A memory chip, e.g., an integrated circuit or "microchip," is an example of such a memory device 1300. The memory device 1300 may be contained within an insulator 1302, which may serve to protect physically and electrically, the memory device 1300.

The identifier 362 may also include two electrodes 1304, 1306, e.g., on a radial inside and a radial outside of the identifier 362. In an example, the radial inside electrode 1304 may be in contact with the pipe 350. Wires 1310 and 1312 may extend between and couple the electrodes 1304, 1306 with the memory device 1300. The wires 1310, 1312 may communicate power and/or signal transmissions. Accordingly, when a sensing device is brought into contact with the electrode 1306, the device may be capable of reading the information stored in the memory device 1300 via wired electrical communication.

Figure 14:
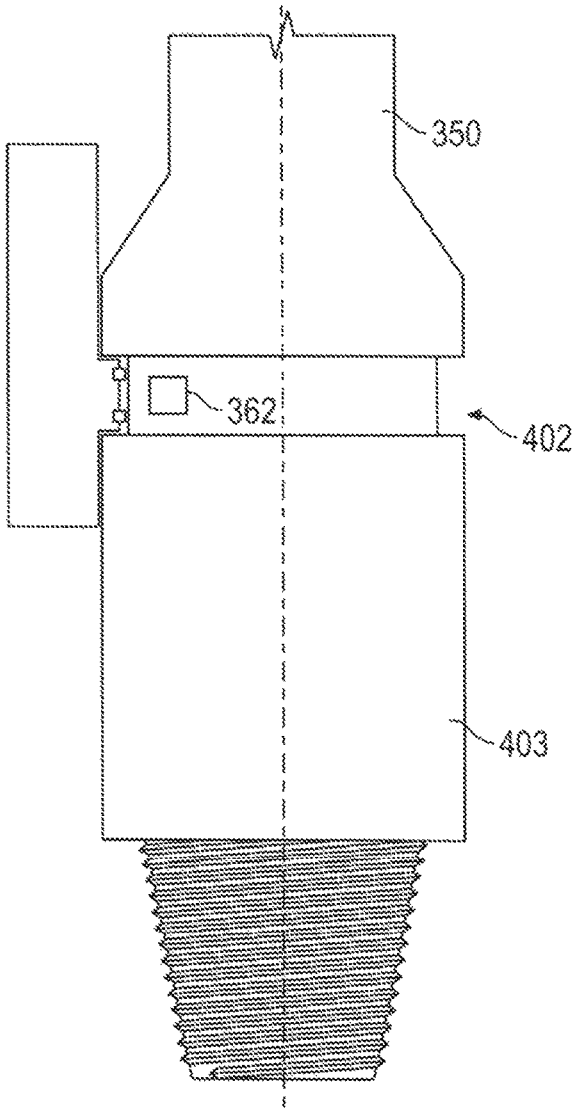
FIG. 14 illustrates a side, schematic view of the pipe, the identifier, and a sensor, according to an embodiment.

FIG. 14 illustrates a side, schematic view of the pipe 350, the identifier 362, and a sensor 1400, according to an embodiment. Referring back to FIG. 3, the sensor 1400 may be the sensor 311 on the drilling device 310, the sensor 332 on the iron roughneck 328, or another sensor, e.g., positioned between the rig floor 302 and the drilling device 310, so as to read the identifier 362 from one, some, or each new pipe 350 that is added to the string 330. The identifier 362 may be any of the embodiments previously described, combinations thereof, or the like.

The sensor 1400 may thus employ one or more of various techniques and devices for detecting information from the identifier 362. For example, the sensor 1400 may include an induction sensor and/or a conductivity sensor, so as to determine holes, plugs, plug orientation, etc. The sensor 1400 may additionally or instead include a linear variable differential transformer (LVDT), which may determine groove and/or gap positions, hole locations, plug orientation, plug contours, etc. The sensor 1400 may also include a probe that may be coupled to, and may provide power to, the memory device 1300 embodiment of the identifier 362. It will be appreciated that the various embodiments of the identifier 362 and the corresponding devices/techniques employed in the sensor 1400 may be combined and are not mutually exclusive.

Figure 15:
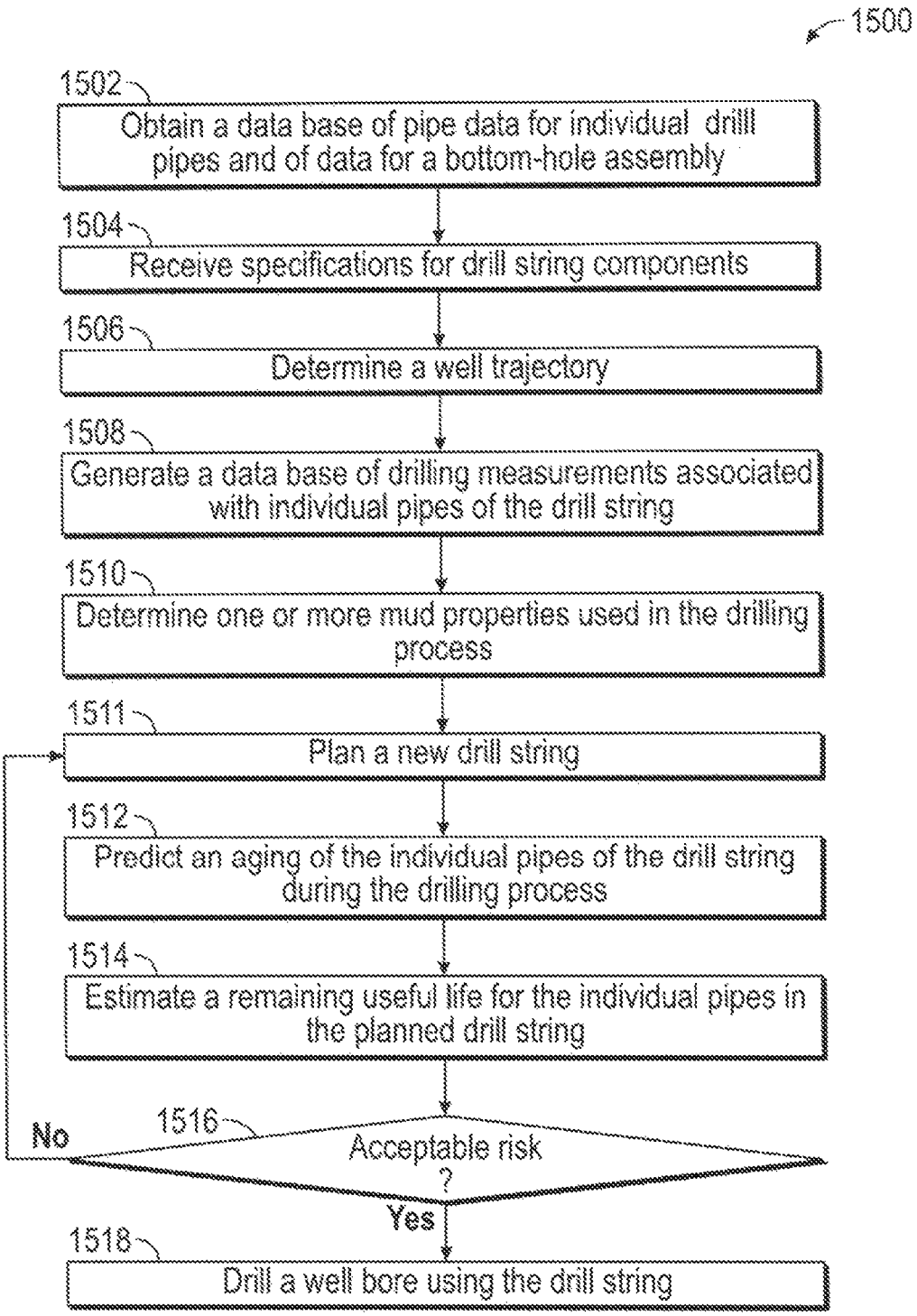
FIG. 15 illustrates a flowchart of a method for drilling a well, according to an embodiment.

FIG. 15 illustrates a flowchart of a method 1500 for drilling a wellbore, according to an embodiment. The method 1500 may begin by obtaining, as input, a database of pipe data for individual drill pipes and of data for a bottom-hole assembly (BHA), as at 1502. The drill pipe data may include drill pipe nominal specifications, material, expected life data, and data determined in previous inspections of the drill pipe (e.g., inner diameter, outer diameter, corrosion, cracks, etc.). This database may thus provide a baseline of the drill pipes that are available for use in a drill string. Further, the BHA data may include the number of components, inner diameter, outer diameter, length, type of connections, functionality, and material of the BHA. Information for one BHA or several different BHAs may be provided in the database.

Although referred to as "a database," it will be appreciated that this database may be provided by one or more distributed databases containing any subset of the above-mentioned data, or other data. Further, in general, information may be associated with the individual pipes via the identification number provided by the identifier 362, which may be unique for each the pipes of a given string. This identification number may then be associated with the properties of the pipe in the database, e.g., with one row of information for each pipe.

The method 1500 may then include receiving specifications for drill sting components, as at 1504. This may be received as part of a well plan or survey, and may specify inner diameters, outer diameters, material, length, etc. The method 1500 may also include determining a well trajectory, as at 1506, which may also be received from a well planning platform, a survey, or the like.

The method 1500 may further include generating a database of drilling measurements associated with individual pipes of the drill string, as at 1508. The measurements may include planned or actual drilling parameters, such as weight-on-bit, rate-of-penetration, bit depth, rotation speed, etc. The measurements may also include reaming information, trip time, recovery (jar) pull force, and/or number of jar firings. The drilling measurements may be associated with the individual pipes in the database using the identification number provided by the identifier 362.

The method 1500 may further include determining one or more mud properties for mud in the drilling process, as at 1510. This may include density, flow rate, rheology, transported cuttings, pH, and the presence of hydrogen gas, carbon dioxide, and/or hydrogen sulfide.

The well trajectory, drilling measurements, and mud properties may be employed to plan a new drill string, as at 1511. This may include building a model (e.g., a digital representation) of the drill string and placing each individual drill pipe, e.g., based on fatigue life thereof and the fatigue that will be imposed on the drill string at the various locations thereof during the drilling process (e.g., performed under the drilling measurements and mud properties).

The method 1500 may then proceed to predicting an aging of the individual pipes of the drill string during the drilling process, as at 1512. Each pipe may be ordered in the drill string, and the drilling parameters, mud parameters, etc. loaded into an engine that may determine the bending cycles, torque, tensile and/or compressive loads, incident on each pipe as the wellbore is drilled. This information may be used to determine an "aging" of each individual pipe of the drill string.

Once the aging of the individual drill pipes is determined, with a known remaining fatigue life of each individual drill pipe, the method 1500 may proceed to estimating a remaining useful life for the individual pipes in the planned drill string, as at 1514. If the remaining useful life is zero, or within a safety factor of zero remaining life, the risk of failure of the pipe may be too high, and thus, at 1516, the determination may be that the risk is unacceptable (i.e., 'NO'). If so, the method 1500 may loop back to planning the drill string at 1511, and may, for example, recommend reorganizing and/or substituting one or more of the pipes of the drill string. Otherwise, if the risk of failure is acceptable (i.e., 'YES' at 1516), the method 1500 may proceed to drilling the wellbore using the planned drill string, e.g., in addition to the well trajectory, mud properties, drilling measurements, etc.

Figure 16:
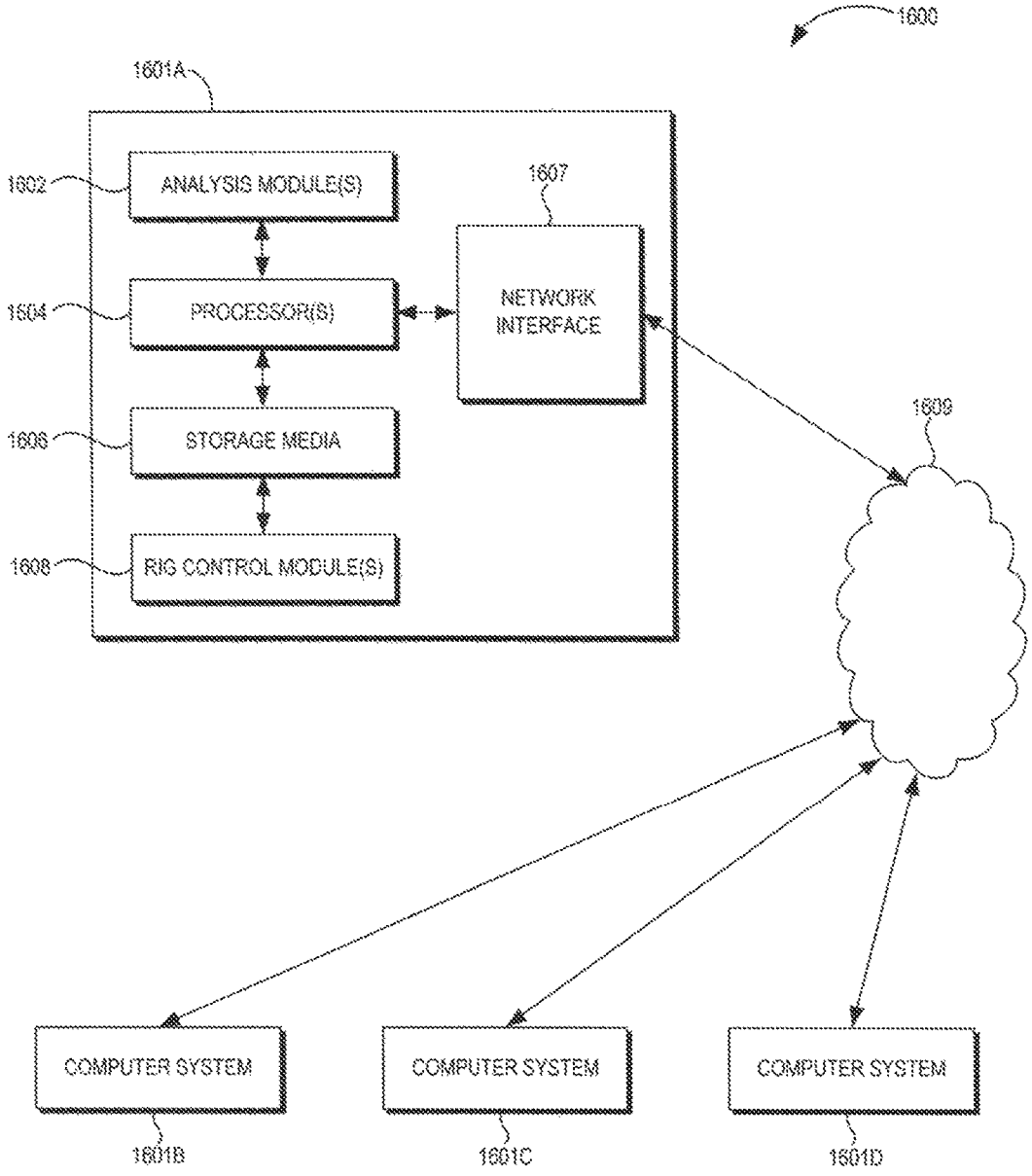
FIG. 16 illustrates an example of such a computing system, according to an embodiment.

In some embodiments, the methods of the present disclosure may be executed by a computing system. FIG. 16 illustrates an example of such a computing system 1600, in accordance with some embodiments. The computing system 1600 may include a computer or computer system 1601A, which may be an individual computer system 1601A or an arrangement of distributed computer systems. The computer system 1601A includes one or more analysis modules 1602 that are configured to perform various tasks according to some embodiments, such as one or more methods disclosed herein. To perform these various tasks, the analysis module 1602 executes independently, or in coordination with, one or more processors 1604, which is (or are) connected to one or more storage media 1606. The processor(s) 1604 is (or are) also connected to a network interface 1607 to allow the computer system 1601A to communicate over a data network 1609 with one or more additional computer systems and/or computing systems, such as 1601B, 1601C, and/or 1601D (note that computer systems 1601B, 1601C and/or 1601D may or may not share the same architecture as computer system 1601A, and may be located in different physical locations, e.g., computer systems 1601A and 1601B may be located in a processing facility, while in communication with one or more computer systems such as 1601C and/or 1601D that are located in one or more data centers, and/or located in varying countries on different continents).

A processor may include a microprocessor, microcontroller, processor module or subsystem, programmable integrated circuit, programmable gate array, or another control or computing device.

The storage media 1606 may be implemented as one or more computer-readable or machine-readable storage media. Note that while in the example embodiment of FIG. 16 storage media 1606 is depicted as within computer system 1601A, in some embodiments, storage media 1606 may be distributed within and/or across multiple internal and/or external enclosures of computing system 1601A and/or additional computing systems. Storage media 1606 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURRY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 1600 contains one or more rig control module(s) 1608. In the example of computing system 1600, computer system 1601A includes the rig control module 1608. In some embodiments, a single rig control module may be used to perform some or all aspects of one or more embodiments of the methods disclosed herein. In alternate embodiments, a plurality of rig control modules may be used to perform some or all aspects of methods herein.

It should be appreciated that computing system 1600 is only one example of a computing system, and that computing system 1600 may have more or fewer components than shown, may combine additional components not depicted in the example embodiment of FIG. 16, and/or computing system 1600 may have a different configuration or arrangement of the components depicted in FIG. 16. The various components shown in FIG. 16 may be implemented in hardware, software, or a combination of both hardware and software, including one or more signal processing and/or application specific integrated circuits.

Further, the aspects of the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of the present disclosure.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A pipe for a drill string, the pipe comprising an identifier that represents an identification number that is read by a sensor, wherein the identifier comprises one or more physical features of the pipe, wherein the one or more physical features comprise a hole, the identifier further comprising a plug disposed in the hole, wherein an orientation of the plug represents at least a portion of the identification number.

2. The pipe of claim 1, wherein the plug is constructed from a first material and defines a plug hole extending inward from a top thereof, the plug comprising a second plug positioned in the plug hole, the second plug being fabricated from a material that is different from a material from which the plug is made, and wherein the orientation of the plug is detectable based on an angle between the second plug and a reference axis.

3. The pipe of claim 1, wherein the plug comprises a top and is constructed at least partially from an electrically-conductive material, the plug defining therein a discontinuity in the top, wherein the orientation of the plug is detectable based on an orientation of the discontinuity in the electrically-conductive material.

* * * * *